US012422142B2

(12) United States Patent
Binek et al.

(10) Patent No.: US 12,422,142 B2
(45) Date of Patent: Sep. 23, 2025

(54) FUEL INJECTOR ASSEMBLY FOR A TURBINE ENGINE

(71) Applicant: RTX Corporation, Farmington, CT (US)

(72) Inventors: Lawrence A. Binek, Glastonbury, CT (US); Timothy S. Snyder, Glastonbury, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/197,299

(22) Filed: May 15, 2023

(65) Prior Publication Data

US 2024/0044495 A1 Feb. 8, 2024

Related U.S. Application Data

(63) Continuation of application No. 17/108,606, filed on Dec. 1, 2020, now Pat. No. 11,649,964.

(51) Int. Cl.

| | |
|---|---|
| ***F23R 3/28*** | (2006.01) |
| ***F23D 7/00*** | (2006.01) |
| ***F23D 11/00*** | (2006.01) |
| ***F23D 11/14*** | (2006.01) |
| ***F23D 14/58*** | (2006.01) |
| ***F23D 14/64*** | (2006.01) |
| ***F23R 3/30*** | (2006.01) |
| ***F23R 3/32*** | (2006.01) |
| ***F23R 3/60*** | (2006.01) |

(52) U.S. Cl.

CPC ..... *F23R 3/28* (2013.01); *F23D 14/58* (2013.01); *F23D 14/64* (2013.01); *F23R 3/32* (2013.01); *F23R 3/60* (2013.01); *F23D 7/00* (2013.01); *F23D 11/005* (2013.01); *F23D 11/14* (2013.01); *F23D 2206/10* (2013.01); *F23D 2900/11001* (2013.01); *F23R 3/30* (2013.01)

(58) Field of Classification Search

CPC ..... F23D 7/00; F23D 11/005; F23D 11/14; F23D 14/58; F23D 14/64; F23R 3/30; F23R 3/32; F23R 3/90

See application file for complete search history.

(56) References Cited

U.S. PATENT DOCUMENTS

| | | | |
|---|---|---|---|
| 1,460,470 | A | 7/1923 | Joseph |
| 2,385,833 | A | 10/1945 | Nahigyan |
| 2,616,258 | A | 11/1952 | Mock |
| 2,727,358 | A | 12/1955 | Leslie |
| 3,053,461 | A | 9/1962 | Inglis |
| 3,153,323 | A | 10/1964 | Hamm |
| 3,430,443 | A | 3/1969 | Frederick |
| 3,603,711 | A | 9/1971 | Downs |
| 3,693,354 | A | 9/1972 | Hull, Jr. |
| 3,693,889 | A | 9/1972 | Schuster |
| 3,777,983 | A | 12/1973 | Hibbins |
| 3,886,736 | A | 6/1975 | Kawaguchi |

(Continued)

*Primary Examiner* — Jason H Duger

(74) *Attorney, Agent, or Firm* — Getz Balich LLC

(57) ABSTRACT

An apparatus is provided for a turbine engine. This turbine engine apparatus includes a monolithic body. The monolithic body includes a splash plate and a fuel nozzle. The splash plate includes a splash plate surface. The fuel nozzle includes a nozzle orifice. The fuel nozzle is configured to direct fuel out of the nozzle orifice to impinge against the splash plate surface.

10 Claims, 11 Drawing Sheets

(56) References Cited

U.S. PATENT DOCUMENTS

| | | | | | |
|---|---|---|---|---|---|
| 3,912,164 | A | | 10/1975 | Lefebvre | |
| 3,915,137 | A | | 10/1975 | Evans | |
| 3,937,007 | A | | 2/1976 | Kappler | |
| 4,028,044 | A | | 6/1977 | Carlisle | |
| 4,081,958 | A | | 4/1978 | Schelp | |
| 4,134,260 | A | | 1/1979 | Lefebvre | |
| 4,242,863 | A | | 1/1981 | Bailey | |
| 4,295,821 | A | | 10/1981 | Schilling | |
| 4,305,255 | A | | 12/1981 | Davies | |
| 4,967,562 | A | * | 11/1990 | Shekleton | F23R 3/28 60/738 |
| 4,989,404 | A | | 2/1991 | Shekleton | |
| 5,063,745 | A | | 11/1991 | Shekleton | |
| 5,129,226 | A | | 7/1992 | Bigelow | |
| 5,133,192 | A | | 7/1992 | Overton | |
| 5,140,807 | A | | 8/1992 | Shekleton | |
| 5,167,122 | A | * | 12/1992 | Shekleton | F02C 7/26 60/743 |
| 5,241,818 | A | | 9/1993 | Shekleton | |
| 5,263,316 | A | | 11/1993 | Shekleton | |
| 5,277,022 | A | * | 1/1994 | Shekleton | F23R 3/32 60/737 |
| 5,321,951 | A | | 6/1994 | Falls | |
| 5,423,178 | A | | 6/1995 | Mains | |
| 5,568,721 | A | | 10/1996 | Alary | |
| 5,836,163 | A | | 11/1998 | Lockyer | |
| 5,873,237 | A | | 2/1999 | Medla | |
| 6,438,961 | B2 | | 8/2002 | Tuthill | |
| 6,460,344 | B1 | | 10/2002 | Steinthorsson | |
| 6,490,864 | B1 | | 12/2002 | Joos | |
| 6,672,066 | B2 | | 1/2004 | Wrubel | |
| 6,931,862 | B2 | | 8/2005 | Harris | |
| 6,986,253 | B2 | | 1/2006 | Leen | |
| 7,870,736 | B2 | | 1/2011 | Homitz | |
| 7,891,191 | B2 | | 2/2011 | Yoshida | |
| 7,954,328 | B2 | | 6/2011 | Atassi | |
| 9,062,609 | B2 | | 6/2015 | Mehring | |
| 9,383,145 | B2 | | 7/2016 | Weber | |
| 9,803,498 | B2 | | 10/2017 | Jewess | |
| 10,139,108 | B2 | | 11/2018 | Thackway | |
| 10,570,865 | B2 | | 2/2020 | Zhang | |
| 10,619,855 | B2 | | 4/2020 | Brogan | |
| 10,739,005 | B2 | | 8/2020 | Kironn | |
| 2002/0069645 | A1 | | 6/2002 | Mowill | |
| 2006/0213180 | A1 | | 9/2006 | Koshoffer | |
| 2007/0044476 | A1 | | 3/2007 | Koshoffer | |
| 2008/0201008 | A1 | | 8/2008 | Twelves | |
| 2009/0020266 | A1 | | 1/2009 | Weber | |
| 2009/0255264 | A1 | | 10/2009 | Mcmasters | |
| 2009/0260365 | A1 | | 10/2009 | Muldoon | |
| 2010/0050653 | A1 | | 3/2010 | Lam | |
| 2010/0281871 | A1 | | 11/2010 | Hadley | |
| 2011/0113789 | A1 | * | 5/2011 | Duval | F23R 3/283 415/208.1 |
| 2011/0289928 | A1 | | 12/2011 | Fox | |
| 2011/0296839 | A1 | | 12/2011 | Van Nieuwenhuizen | |
| 2013/0098048 | A1 | | 4/2013 | Popovic | |
| 2016/0209041 | A1 | | 7/2016 | Twelves, V | |
| 2020/0109663 | A1 | | 4/2020 | Binek | |
| 2020/0362724 | A1 | * | 11/2020 | Binek | F23R 3/54 |

* cited by examiner

FUEL INJECTOR ASSEMBLY FOR A TURBINE ENGINE

This application is a continuation of U.S. patent application Ser. No. 17/108,606 filed Dec. 1, 2020, which is hereby incorporated herein by reference in its entirety.

BACKGROUND OF THE DISCLOSURE

1. Technical Field

This disclosure relates generally to a turbine engine and, more particularly, to a fuel injector assembly for the turbine engine.

2. Background Information

A combustor section in a modern a turbine engine includes one or more fuel injectors. Each fuel injector is operable to inject fuel for combustion within a combustion chamber. Various types and configurations of fuel injectors are known in the art. While these known fuel injectors have various benefits, there is still room in the art for improvement. There is a need in the art, for example, for fuel injectors with reduced manufacturing costs, that facilitate reduced assembly time as well as that reduce likelihood of carbon buildup within the combustion chamber caused by solidification of and/or traces of non-combusted fuel.

SUMMARY OF THE DISCLOSURE

According to an aspect of the present disclosure, an apparatus is provided for a turbine engine. This turbine engine apparatus includes a monolithic body. The monolithic body includes a splash plate and a fuel nozzle. The splash plate includes a splash plate surface. The fuel nozzle includes a nozzle orifice. The fuel nozzle is configured to direct fuel out of the nozzle orifice to impinge against the splash plate surface.

According to another aspect of the present disclosure, another apparatus is provided for a turbine engine. This turbine engine apparatus includes a structure, a fuel nozzle and a splash plate. The structure includes a fluid passage. The structure is configured to direct an axial fluid flow through the fluid passage. The fuel nozzle includes a nozzle orifice. The splash plate is arranged within the fluid passage and includes a splash plate surface. The fuel nozzle is configured to direct fuel out of the nozzle orifice to impinge against the splash plate surface. The splash plate is configured to disperse the fuel that impinges against the splash plate surface into the axial fluid flow.

According to still another aspect of the present disclosure, another apparatus is provided for a turbine engine. This turbine engine apparatus includes a fuel nozzle and a splash plate. The fuel nozzle includes a nozzle orifice. The splash plate includes a splash plate surface spaced from the fuel nozzle. The fuel nozzle is configured to direct a fuel jet out of the nozzle orifice along a fuel jet trajectory to the splash plate surface. The splash plate is configured to disperse fuel from the fuel jet in a radial outward pattern. The splash plate surface is angularly offset from the fuel jet trajectory by an acute angle.

The axial fluid flow may be or otherwise include a non-swirled fluid flow.

The splash plate may be integral with the fuel nozzle.

The splash plate may be configured with the fuel nozzle in a monolithic body.

The turbine engine assembly may also include a structure that includes an air passage. The structure may be configured to direct air through the air passage. The splash plate may be configured to disperse the fuel from the fuel jet in the radial outward pattern into the air within the air passage.

The fuel nozzle may be configured to direct the fuel out of the nozzle orifice as a fuel jet. The splash plate may be configured to redirect the fuel jet into a radiant pattern of fuel.

The splash plate may be spaced from and/or may overlap the nozzle orifice.

The splash plate surface may be configured as or otherwise include a planar splash plate surface.

The fuel nozzle may be configured to direct the fuel out of the nozzle orifice along a trajectory to impinge against the splash plate surface. The splash plate surface may be angularly offset from the trajectory by an acute angle.

The acute angle may be between sixty degrees (60°) and eighty degrees (80°).

The acute angle may be between thirty-five degrees (35°) and fifty-five degrees (55°).

The turbine engine assembly may also include a support member connecting and extending between the splash plate and the fuel nozzle.

The fuel nozzle may project into a flow passage. The support member may be upstream of the nozzle orifice relative to a fluid flow within the flow passage.

The turbine engine assembly may also include a second support member connecting and extending between the splash plate and the fuel nozzle.

The fuel nozzle may include a nozzle tube that has and extends along a longitudinal centerline. The nozzle orifice may be coaxial with the longitudinal centerline.

The turbine engine assembly may also include a fuel vaporizer. The splash plate may be configured to direct at least some of the dispersed fuel against the fuel vaporizer.

The turbine engine assembly may also include an air tube that includes an air passage. The fuel nozzle may project into the air passage. The splash plate may be arranged within the air passage such that the splash plate is configured to direct at least some of the dispersed fuel against an inner sidewall surface of the air tube.

The turbine engine assembly may also include a combustor wall at least partially forming a combustion chamber. The air tube may be connected to the combustor wall and/or may project into the combustion chamber.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
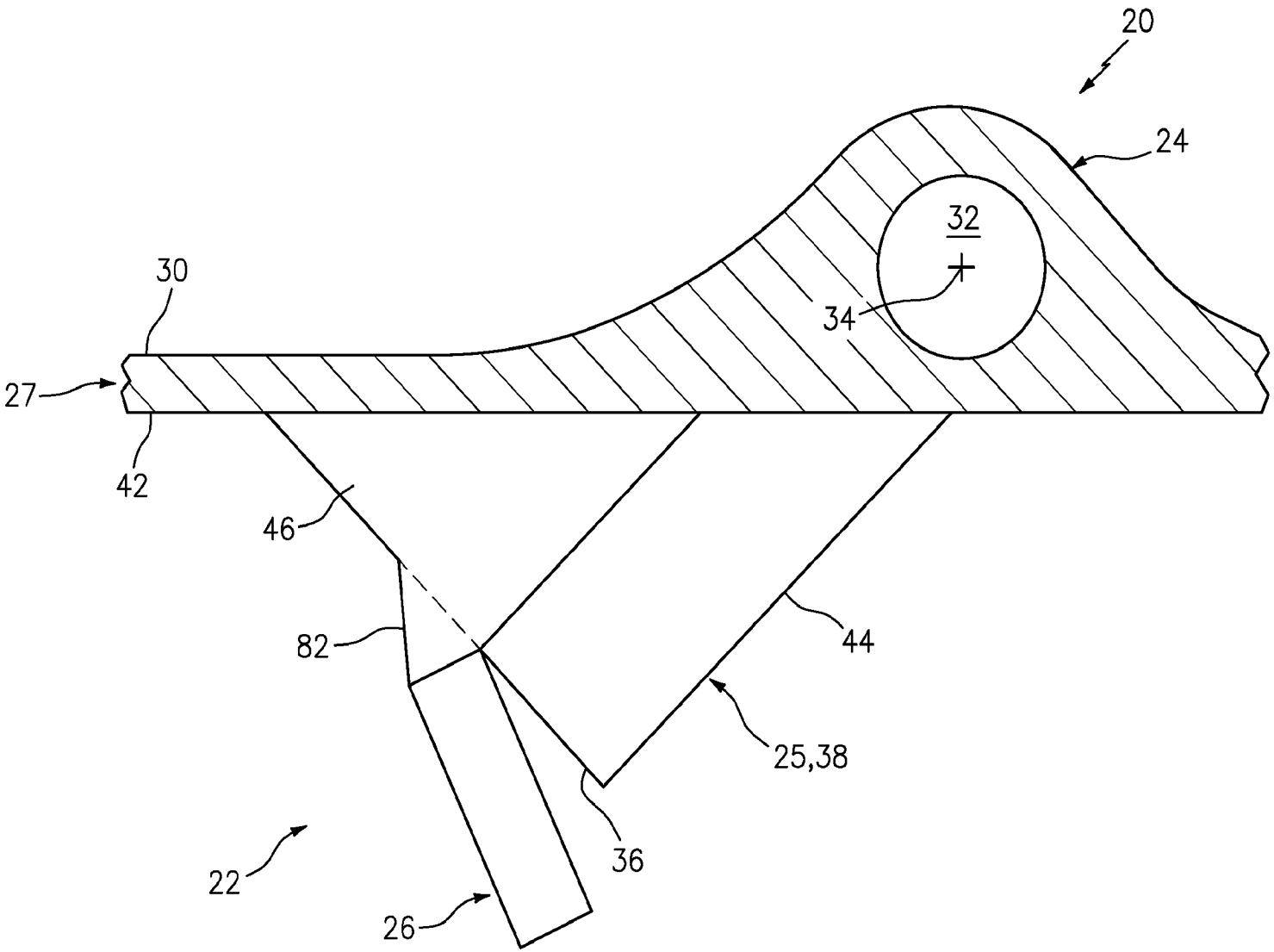
FIGS. 1-4 are side sectional illustrations of portions of a turbine engine apparatus.

FIG. 1 illustrates a portion of an apparatus 20 for a turbine engine. This turbine engine apparatus 20 is configured as, or otherwise includes, a fuel injector assembly 22 for a combustor section of the turbine engine. The turbine engine apparatus 20 includes a fuel conduit 24, a fuel nozzle 25 (e.g., a single and/or central orifice fuel nozzle) and a fuel nozzle splash plate 26. The turbine engine apparatus 20 of FIG. 1 may also include an apparatus base 27, which apparatus base 27 may provide a structural support for the fuel conduit 24 and/or the fuel nozzle 25.

The apparatus base 27 may be configured as any part of the turbine engine within the combustor section that is proximate the fuel injector assembly 22. The apparatus base 27 of FIG. 1, for example, may be configured as a turbine engine case such as, but not limited to, a combustor section case, a diffuser case and/or a combustor wall.

The fuel conduit 24 is configured as, or may be part of, a fuel supply for the fuel nozzle 25. The fuel conduit 24, for example, may be or may be part of a fuel supply tube, a fuel inlet manifold and/or a fuel distribution manifold. The fuel conduit 24 is arranged at and/or is connected to a first side 30 (e.g., an exterior and/or outer side) of the apparatus base 27. The fuel conduit 24 is configured with an internal fuel supply passage 32 formed by an internal aperture (e.g., a bore, channel, etc.) within the fuel conduit 24. The supply passage 32 and the associated aperture extend within and/or through the fuel conduit 24 along a (e.g., curved or straight) centerline 34 of the supply passage 32, which may also be a centerline of the fuel conduit 24.

Figure 2:
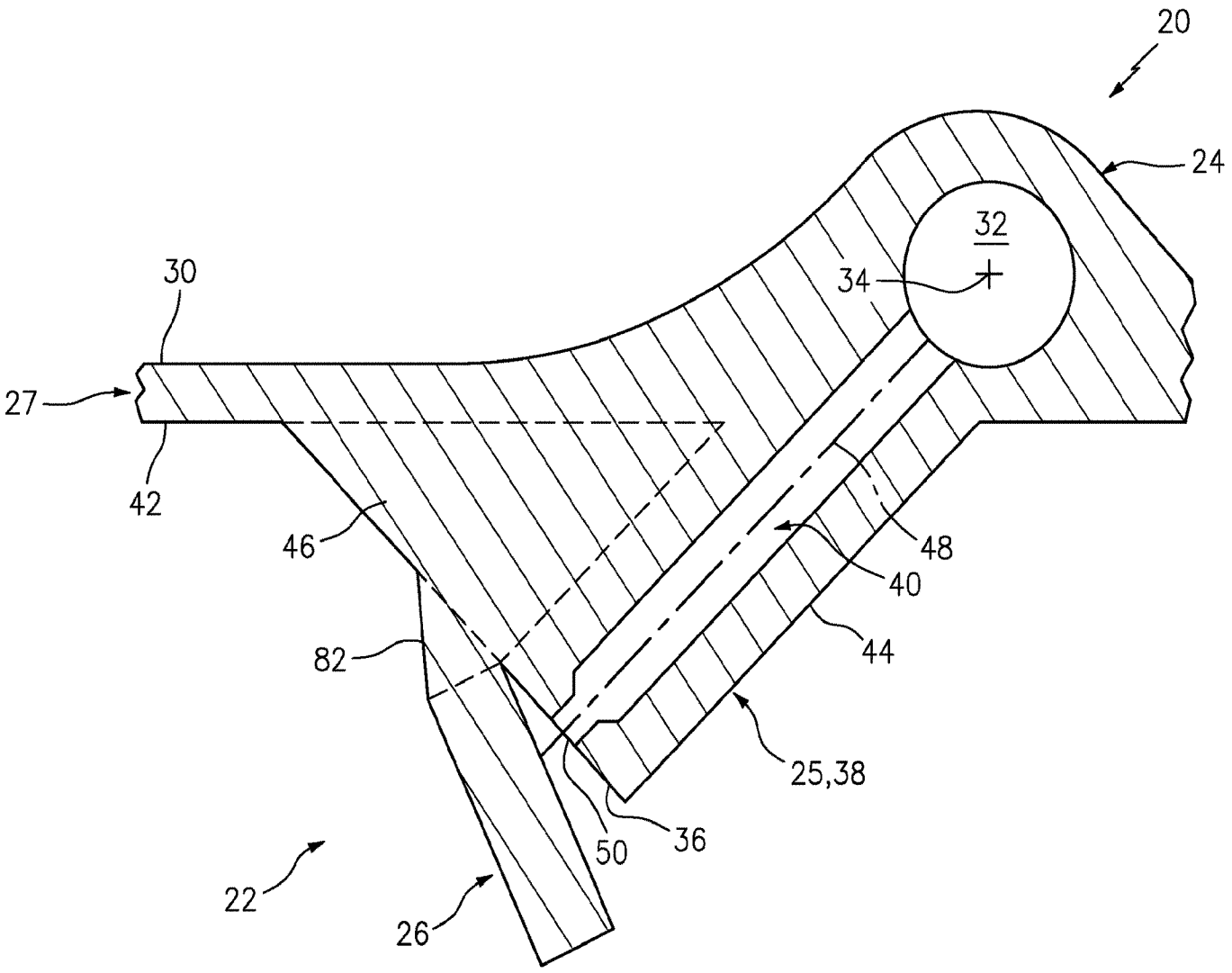

Referring to FIG. 2, the fuel nozzle 25 is configured to receive fuel from the fuel conduit 24, and inject the received fuel into a plenum (e.g., a fluid passage 34 such as an air passage) at a distal end 36 (e.g., tip) of the fuel nozzle 25 to impinge against the splash plate 26. The fuel nozzle 25 of FIG. 2 includes a nozzle body 38 and a nozzle passage 40; e.g., a fuel passage.

The nozzle body 38 is arranged at and/or is connected to a second side 42 (e.g., an interior and/or inner side) of the apparatus base 27, where the base second side 42 is opposite the base first side 30. The nozzle body 38 of FIG. 2 includes a nozzle tube 44 and a nozzle support structure 46 (e.g., a web). A base end of the nozzle tube 44 is connected to the apparatus base 27. The nozzle tube 44 projects longitudinally out from the apparatus base 27 along a (e.g., straight or curved) longitudinal centerline 48 of the nozzle passage 40 and/or the nozzle tube 44 to the fuel nozzle distal end 36. The nozzle support structure 46 is connected to and extends between the apparatus base 27 and a (e.g., upstream) side of the nozzle tube 44. The nozzle support structure 46 structurally ties the nozzle tube 44 to the apparatus base 27 and may thereby support the nozzle tube 44 within the fluid passage 34. The nozzle support structure 46, for example, may form a support gusset for the nozzle tube 44.

An internal bore of the nozzle tube 44 at least partially (or completely) forms the nozzle passage 40. The nozzle passage 40 extends longitudinally along the longitudinal centerline 48 within and/or through the apparatus base 27 and the nozzle tube 44 from the supply passage 32 to a downstream nozzle orifice 50 at the fuel nozzle distal end 36. This nozzle orifice 50 provides an outlet from the nozzle passage 40 and, more generally, the fuel nozzle 25.

Figure 3:
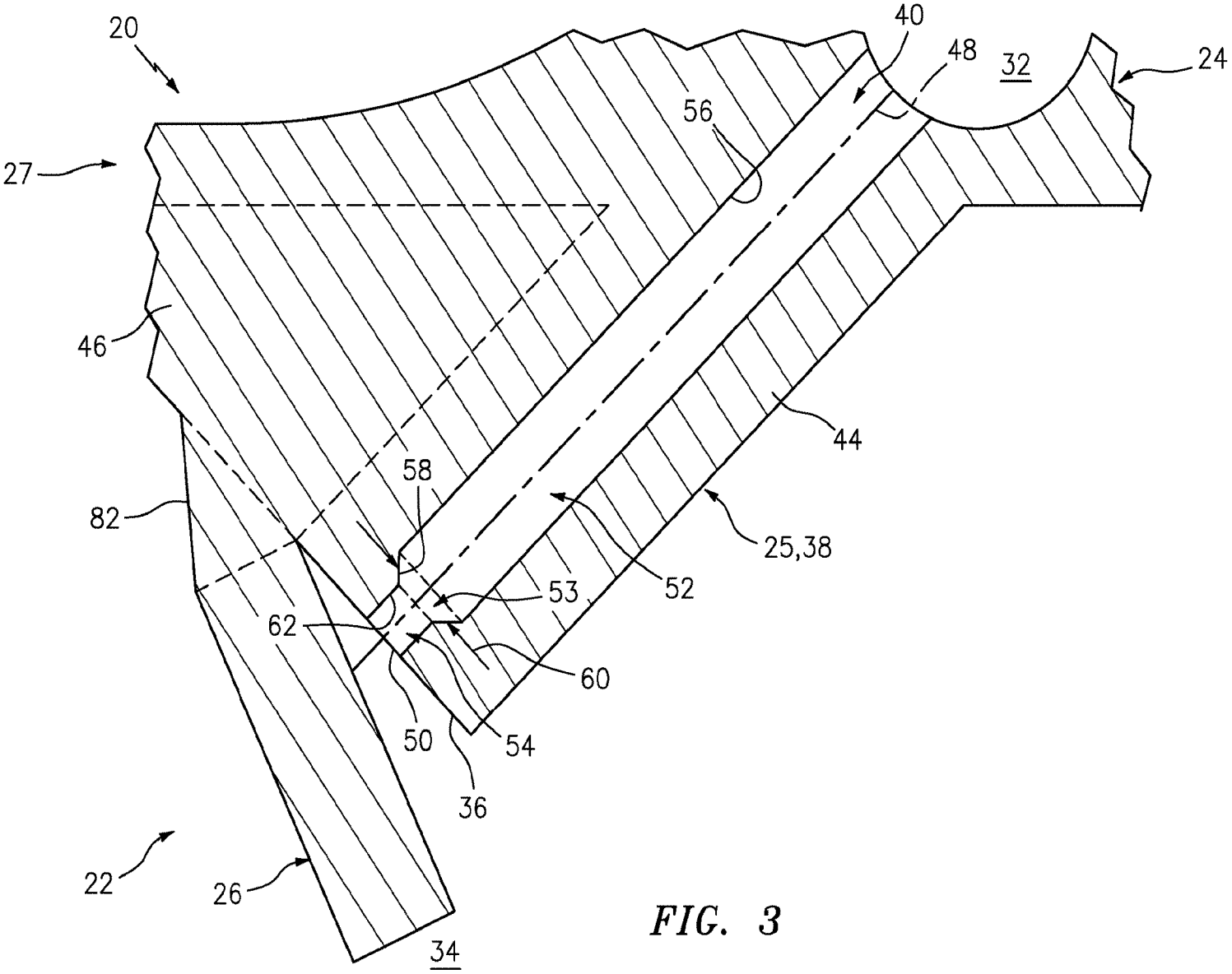

Referring to FIG. 3, the nozzle passage 40 includes one or more different flow portions (e.g., 52-54) arranged longitudinally along the longitudinal centerline 48. The nozzle passage 40 of FIG. 3, for example, includes a (e.g., upstream) flow channel portion 52, a (e.g., intermediate) convergent portion 53 and a (e.g., downstream) throat portion 54.

The flow channel portion 52 is upstream of the convergent portion 53, for example at (e.g., on, adjacent or proximate) an upstream end of the nozzle passage 40. The flow channel portion 52 of FIG. 3, for example, is formed by a (e.g., non-tapering, cylindrical) flow channel sidewall surface 56. This flow channel sidewall surface 56 and, thus, the flow channel portion 52 extends longitudinally along the longitudinal centerline 48 from the supply passage 32 to the convergent portion 53.

The convergent portion 53 is fluidly coupled between the flow channel portion 52 and the throat portion 54. The convergent portion 53 of FIG. 3, for example, is formed by a tapering (e.g., frustoconical) convergent sidewall surface 58. This convergent sidewall surface 58 and, thus, the convergent portion 53 extends longitudinally along the longitudinal centerline 48 from the flow channel portion 52 to the throat portion 54, where a width 60 (e.g., diameter) of the convergent sidewall surface 58 decreases as the convergent portion 53 extends longitudinally towards the throat portion 54/the nozzle orifice 50.

The throat portion 54 is downstream of the convergent portion 53 and/or at the nozzle orifice 50, for example at (e.g., on, adjacent or proximate) the fuel nozzle distal end 36. The throat portion 54 of FIG. 3, for example, is formed by a (e.g., non-tapering, cylindrical) throat sidewall surface 62. This throat sidewall surface 62 and, thus, the throat portion 54 extends longitudinally along the longitudinal centerline 48 from the convergent portion 53 to (or towards) the nozzle orifice 50. A downstream most end of the throat portion 54 may thereby define the nozzle orifice 50. Of course, in other embodiments, the nozzle passage 40 may also include another flow portion (e.g., a divergent portion) arranged longitudinally between the throat portion 54 and the nozzle orifice 50. In still other embodiments, any one or more of the foregoing flow portions 52-54 may also or alternatively be omitted; e.g., the flow channel portion 52 may be omitted where, for example, the convergent portion 53 extends from the supply passage 32 to the throat portion 54. The present disclosure therefore is not limited to the foregoing exemplary nozzle passage configurations.

Figure 4:
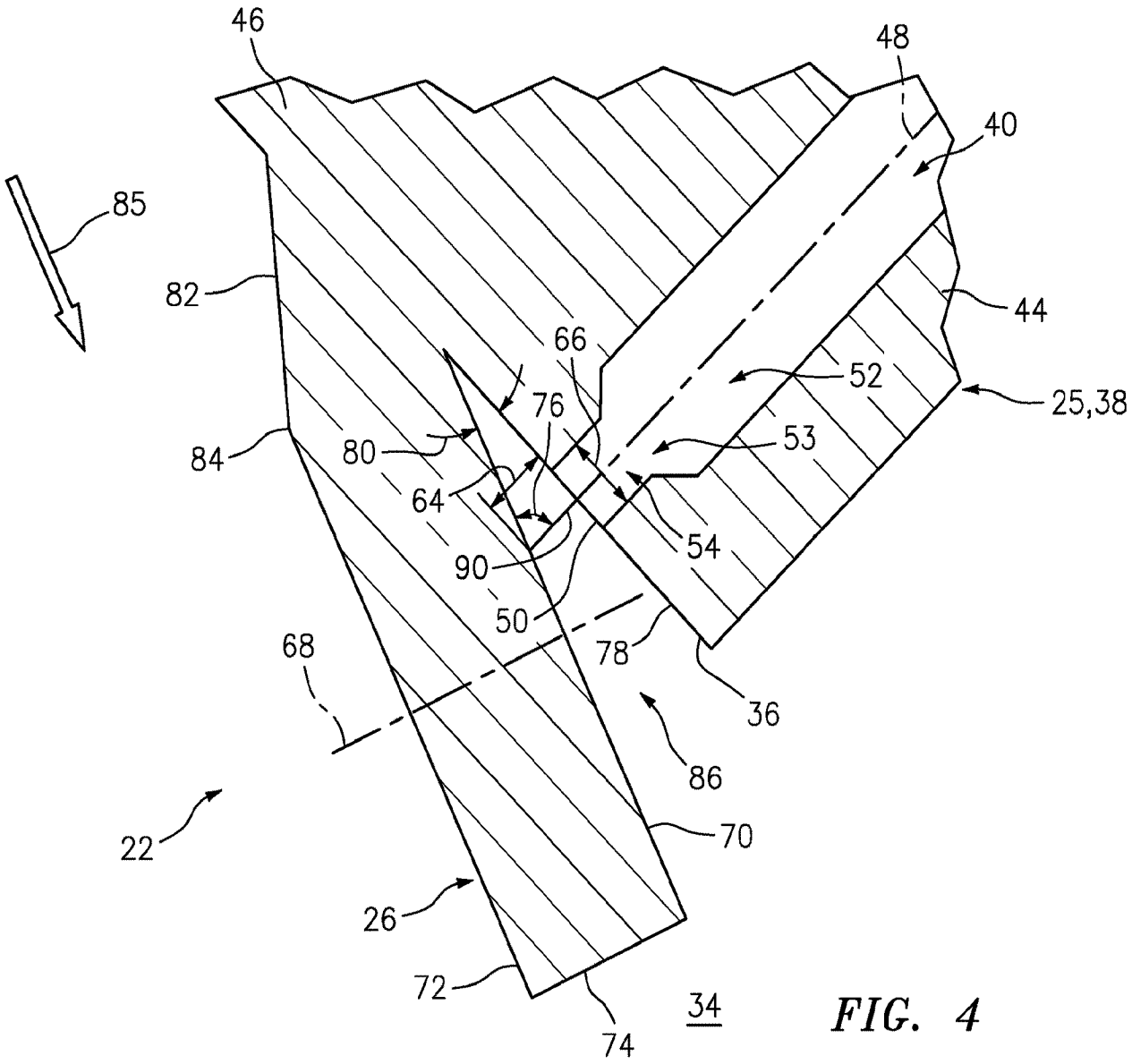
Figure 7:
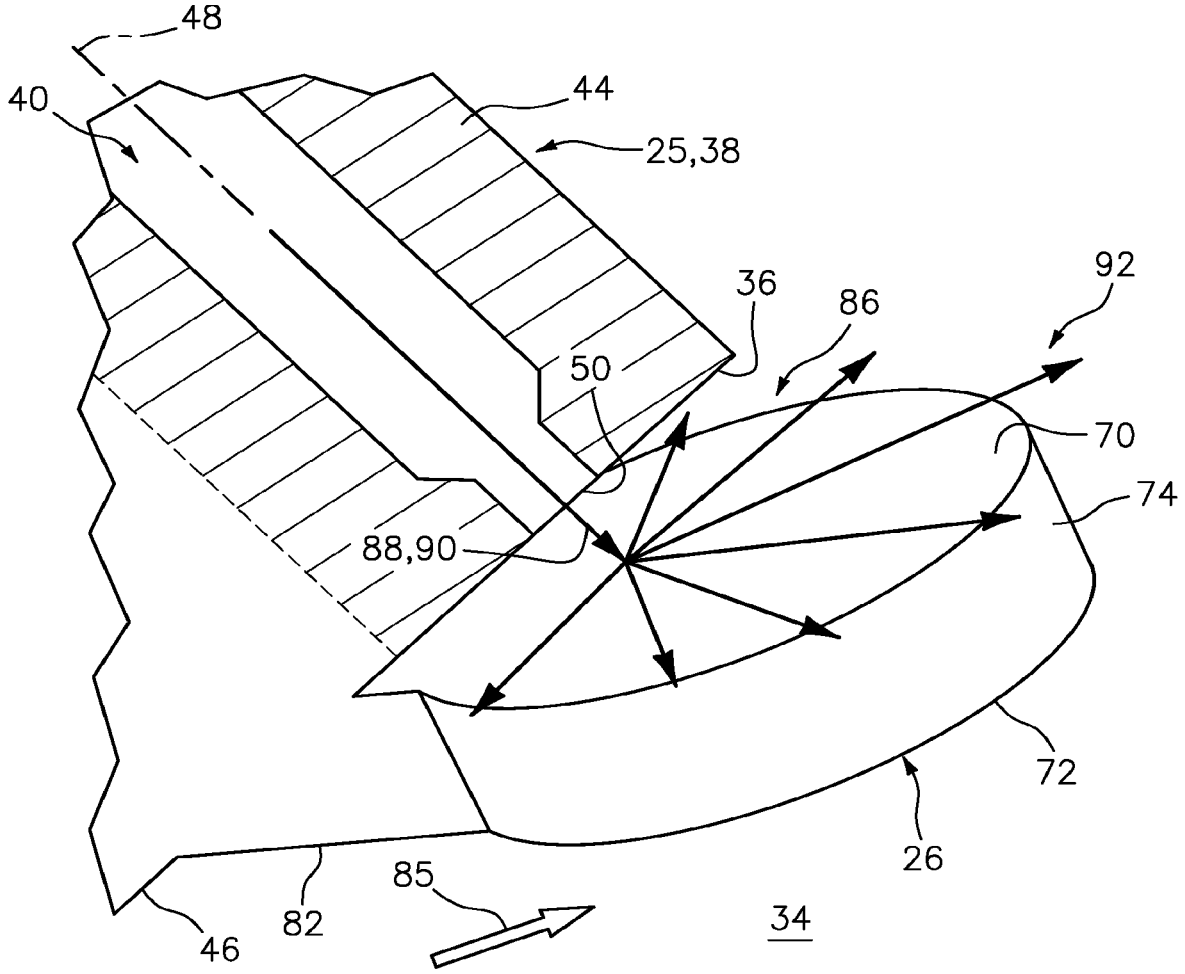
FIG. 7 is a side cutaway illustration of another portion of the turbine engine apparatus schematically depicting an air flow and a fuel flow.
Figure 8:
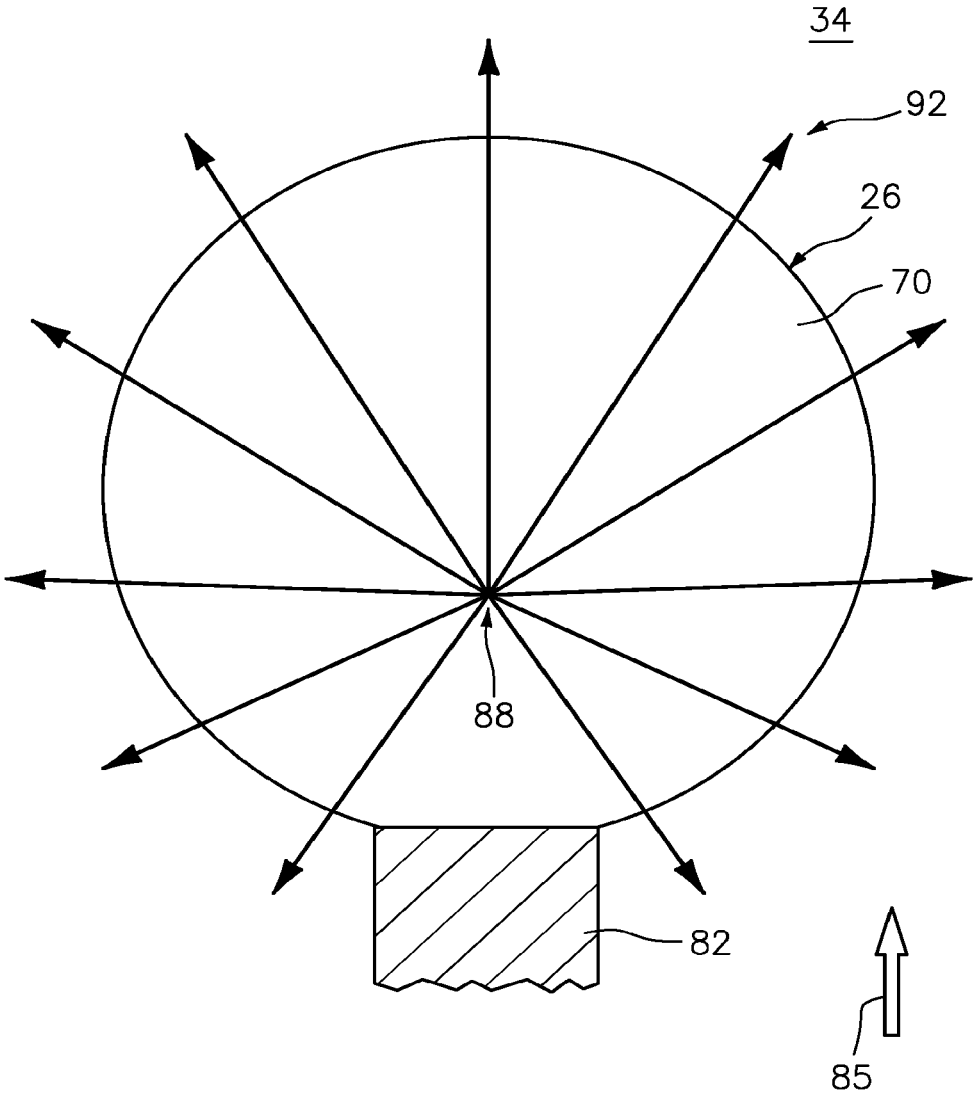
FIG. 8 is an illustration of a splash plate and a section of an associated support member further schematically depicting the fuel flow.

Referring to FIG. 4, the splash plate 26 is configured to redirect (e.g., disperse) the fuel injected into the fluid passage 34 from the fuel nozzle 25 into a disperse (e.g., a widespread) pattern (e.g., see FIGS. 7 and 8). The splash plate 26, for example, is arranged proximate and laterally overlaps the nozzle orifice 50. The splash plate 26 is longitudinally spaced from the fuel nozzle 25 and its nozzle orifice 50 by a longitudinal distance 64 along the longitudinal centerline 48. This longitudinal distance 64 may be equal to or different (e.g., greater or less) than a width (e.g., diameter) of the nozzle passage 40. The longitudinal distance 64 of FIG. 4, for example, is between one-half times (0.5×) and five times (5×) a width 66 (e.g., a diameter) of the throat portion 54. The present disclosure, however, is not limited to the foregoing exemplary dimensional relationship between the splash plate 26 and the fuel nozzle 25.

Figure 5:
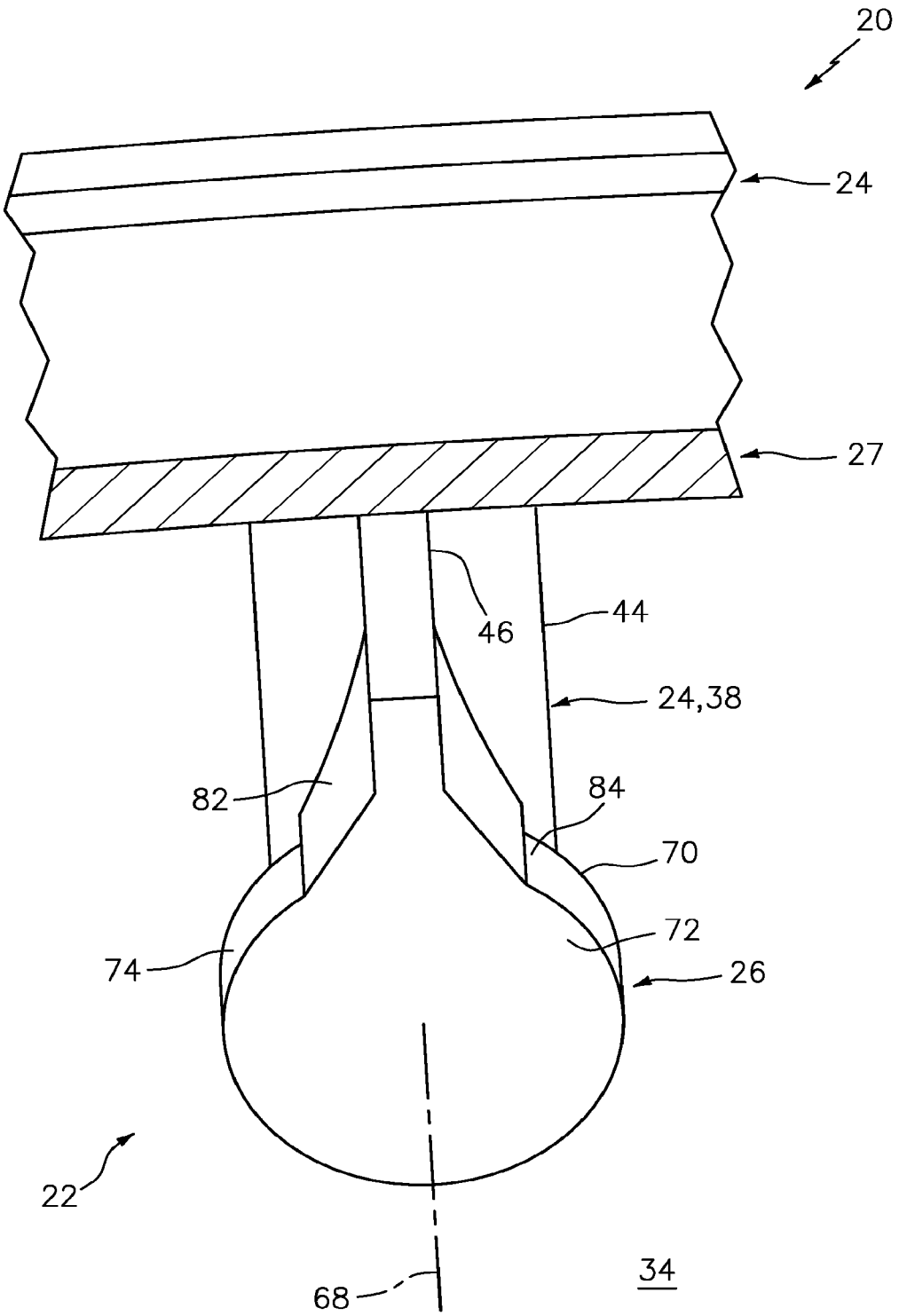
FIG. 5 is a perspective cross-sectional illustration of another portion of the turbine engine apparatus.

The splash plate 26 of FIGS. 4 and 5 is configured with a (e.g., circular) puck-like body. The splash plate 26 of FIG. 4, for example, extends axially along a centerline axis 68 of the splash plate 26 between a frontside splash plate surface 70 and a backside splash plate surface 72, which backside splash plate surface 72 is axially opposite the frontside splash plate surface 70. Each of these splash plate surfaces 70 and 72 may have a generally circular shape. However, in other embodiments, one or more of the splash plate surfaces 70 and 72 may each have a non-circular (e.g., oval, polygonal, etc.) shape. Each of the splash plate surfaces 70 and 72 may be configured as a smooth and/or planar surface. However, in other embodiments, one or more of the splash plate surfaces 70 and 72 may each be configured as a non-planar (e.g., concave, convex, etc.) surface and/or with one or more flow disruptions; e.g., apertures or projections. The splash plate 26 of FIGS. 4 and 5 also includes at least one side perimeter surface 74 that extends axially between the opposing splash plate surfaces 70 and 72 and circumferentially about the centerline axis 68 of the splash plate 26.

Figure 6:
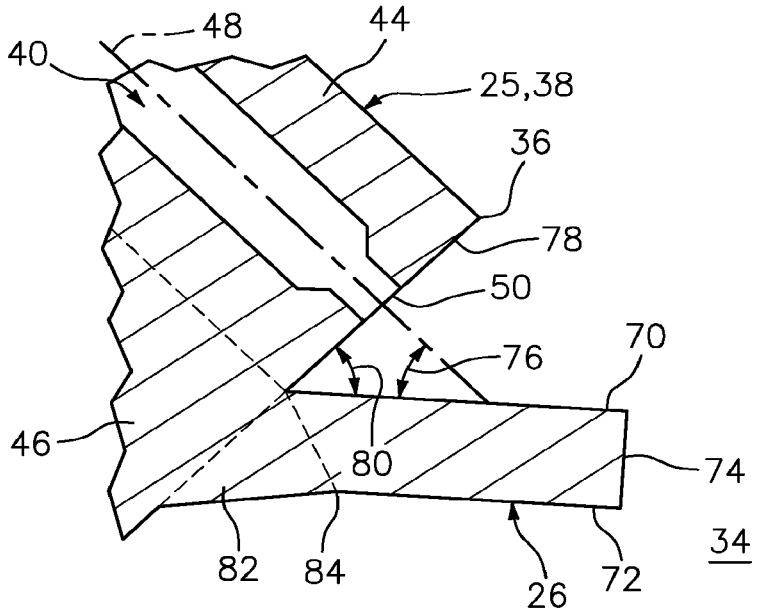
FIG. 6 is a side sectional illustration of another portion of the turbine engine apparatus.

Referring to FIG. 4, the splash plate 26 and, more particularly, its frontside splash plate surface 70 is angularly offset from the longitudinal centerline 48 and/or fuel trajectory 90 (discussed below) by a first acute angle 76 (an angle that is greater than zero degrees and less than ninety degrees) when viewed, for example, in the plane of FIG. 4; e.g., a plane that laterally bisects one or more or each of the components 26, 44 and 46 and/or is parallel with and coincident with the centerline 48. The first acute angle 76 may be between sixty degrees (60°) and eighty degrees (80°) as shown in FIG. 4; e.g., the first acute angle 76 may be substantially (e.g., +/−2°) or exactly equal to seventy degrees (70°). In another example, the first acute angle 76 may be between thirty-five degrees (35°) and fifty-five degrees (55°) as shown in FIG. 6; e.g., the first acute angle 76 may be substantially (e.g., +/−2°) or exactly equal to forty-five degrees (45°).

The splash plate 26 of FIG. 4 and, more particularly, its frontside splash plate surface 70 is angularly offset from a plane of the nozzle orifice 50 and/or a surface 78 of the nozzle tube 44 at the fuel nozzle distal end 36 by a second acute angle 80. The second acute angle 80 may be between ten degrees (10°) and thirty degrees (30°) as shown in FIG. 4; e.g., the second acute angle 80 may be substantially (e.g., +/−2°) or exactly equal to twenty degrees (20°). In another example, the second acute angle 80 may be between thirty-five degrees (35°) and fifty-five degrees (55°) as shown in FIG. 6; e.g., the second acute angle 80 may be substantially (e.g., +/−2°) or exactly equal to forty-five degrees (45°).

The splash plate 26 of FIGS. 4 and 5 is connected to the fuel nozzle 25 by at least (or only) one support member 82. The support member 82 may be configured as a beam and/or a pylon. The support member 82 of FIGS. 4 and 5, for example, has an elongated body that is connected to and extends between the fuel nozzle 25 and the splash plate 26. More particularly, the support member 82 of FIGS. 4 and 5 is connected (e.g., directly) to and extends between the nozzle support structure 46 and the splash plate 26. Of course, in other embodiments, the support member 82 may also or alternatively be connected to and/or project out from the nozzle tube 44.

The support member 82 of FIG. 4 is arranged at (e.g., on, adjacent or proximate) an upstream end 84 of the splash plate 26 relative to a fluid flow 85 (e.g., an air flow) within the fluid passage 34 (e.g., an air passage). The support member 82 may thereby be arranged upstream of the nozzle orifice 50 relative to the fluid flow 85 within the fluid passage 34. With such an arrangement, the fuel redirected (e.g., dispersed) by the splash plate 26 may flow unobstructed in a downstream direction through a spatial gap 86 between the splash plate 26 and the fuel nozzle 25. The present disclosure, however, is not limited to such an exemplary support member placement.

Referring to FIG. 2, during turbine engine operation, fuel is directed into the supply passage 32 from a fuel source (not shown). At least a portion (or all) of the fuel within the supply passage 32 is directed into the nozzle passage 40. Referring to FIG. 7, this fuel flows through the nozzle passage 40 and out of the fuel nozzle 25 through the nozzle orifice 50 and into the fluid passage 34 (more particularly, into the spatial gap 86) as a fuel jet 88 along a fuel jet trajectory 90, which may be parallel (e.g., coaxial) with the centerline 48. This fuel jet 88 may be a linear concentrated flow/stream of fuel versus, for example, a spread-out pattern of fuel such as a conical film of fuel. The fuel jet 88 flows through the spatial gap 86 along its trajectory 90 and impacts (e.g., impinges against) the frontside splash plate surface 70 at a target area; e.g., an impingement area. Referring to FIGS. 7 and 8, upon impacting the frontside splash plate surface 70, the splash plate 26 redirects (e.g., disperses) the impinging fuel jet 88 radially outward (relative to the fuel jet trajectory 90) into a (e.g., uniform and/or symmetrical) disperse radiant pattern 92 (e.g., an arcuate and/or a generally planar film; schematically shown in FIGS. 7 and 8 via discrete flow arrows). The fuel may thereby be more evenly dispersed/spread/mixed into the fluid (e.g., air) flowing past the fuel nozzle 25 and the splash plate 26 within the fluid passage 34. Providing such relatively even mixing of the fuel and the fluid may in turn increase fuel burn efficiency and/or reduce likelihood of carbon formation within the turbine engine.

Figure 9:
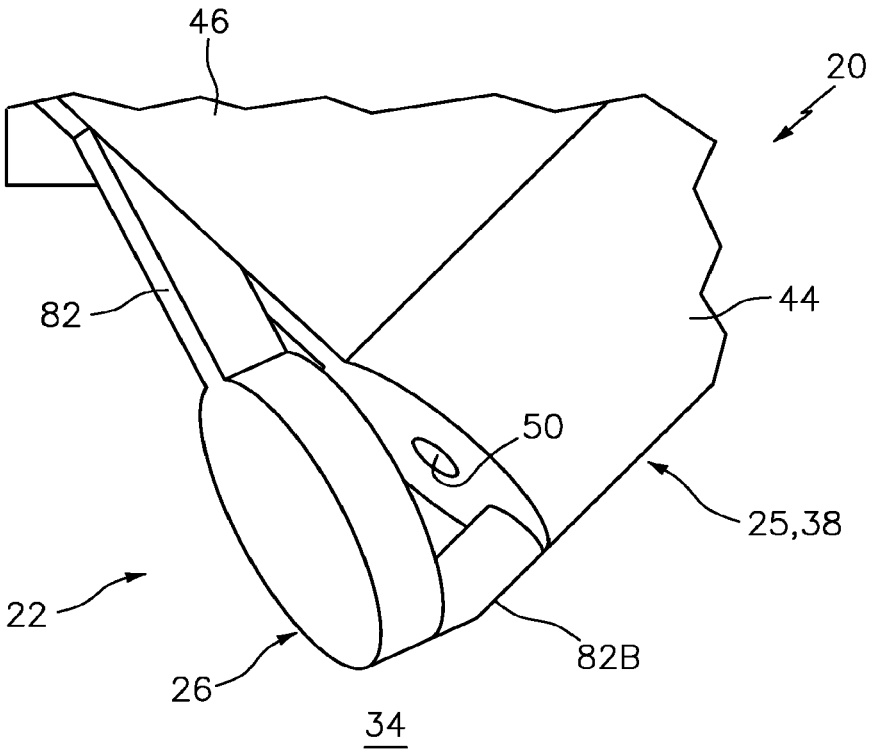
FIGS. 9 and 10 are perspective illustrations of the turbine engine apparatus configured with an additional support member for each splash plate.
Figure 10:
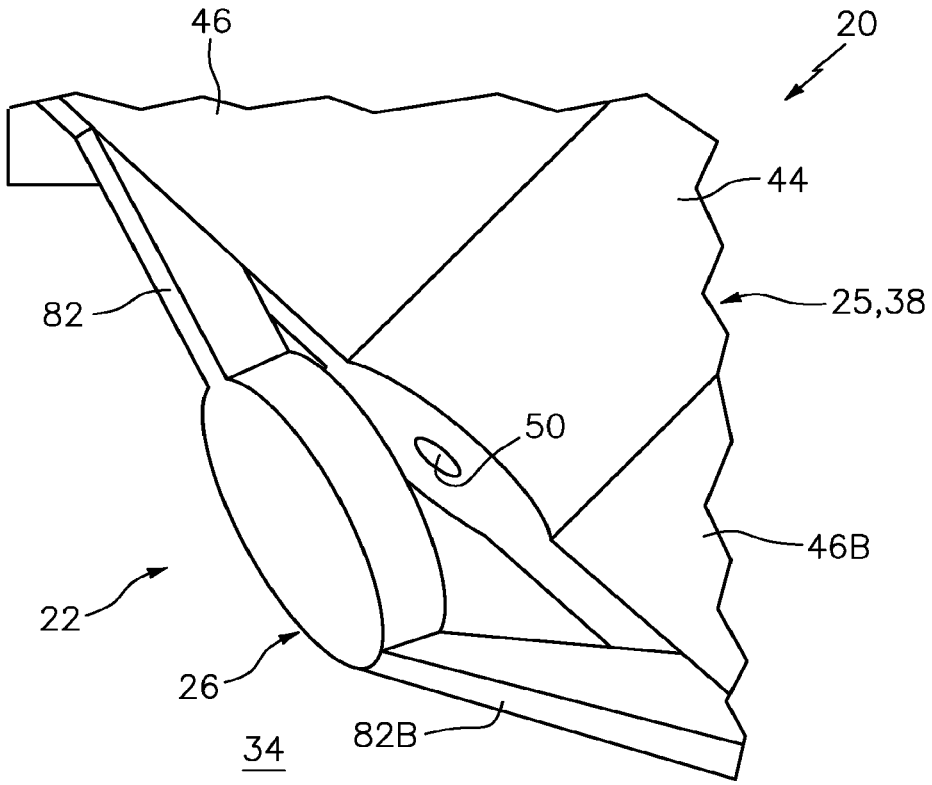

In some embodiments, referring to FIG. 2, the splash plate 26 is cantilevered from the fuel nozzle 25 through the support member 82. In other embodiments, the splash plate 26 may be further supported by at least one additional support member 82B as shown, for example, in FIGS. 9 and 10. This downstream support member 82B is connected to and extends between the fuel nozzle 25 and the splash plate 26. More particularly, the downstream support member 82B of FIG. 9 is connected to and projects out from the nozzle tube 44. The downstream support member 82B of FIG. 10 is connected to and projects out from another (e.g., downstream) nozzle support structure 46B (e.g., web) for the fuel nozzle 25. Referring to FIGS. 9 and 10, the downstream support member 82B may be positioned opposite to (e.g., diametrically opposed with) the upstream support member 82; however, the present disclosure is not limited to such exemplary support member locations.

In addition to increasing structural ties between the splash plate 26 and the fuel nozzle 25, including more than one support member (e.g., 82, 82B) may also provide for reducing the size of the support member (e.g., 82, 82B) e.g., thickness. Reducing the size of the support member(s) (e.g., 82, 82B) may in turn reduce flow impedance to the dispersed fuel traveling past the support members (e.g., 82, 82B) and, thus, promote further mixing between the fuel and the fluid flow; e.g., air flow.

Figure 11:
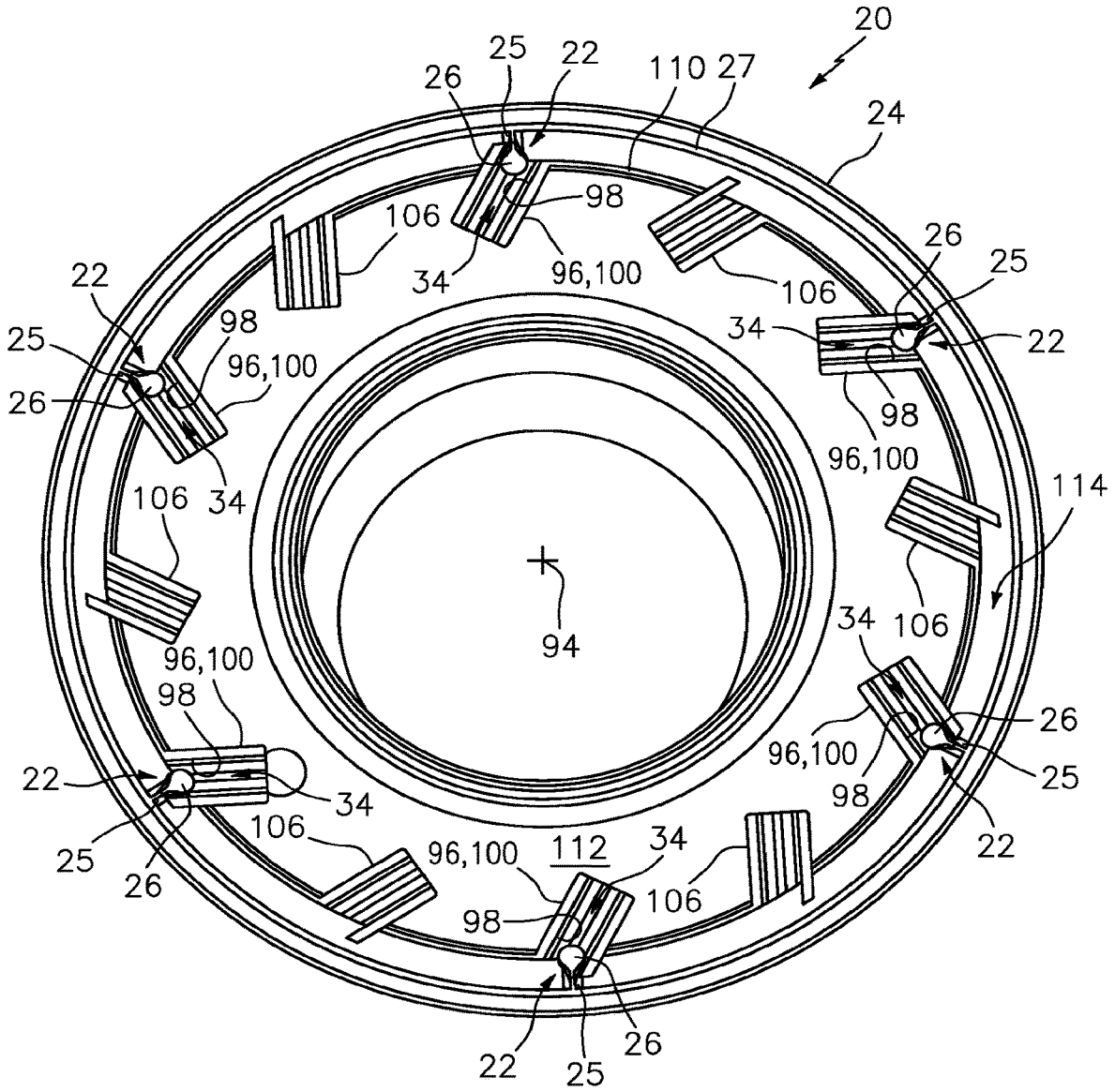
FIG. 11 is a perspective cross-sectional illustration of a portion of a combustor section.

In some embodiments, referring to FIG. 11, the fuel nozzle 25 may be one of a plurality of fuel nozzles 25 connected to the apparatus base 27 and fluidly coupled with the fuel conduit 24. These fuel nozzles 25 may be arranged circumferentially about a centerline/rotational axis 94 of the turbine engine in an annular array. Each of the fuel nozzles 25 may be associated with a respective splash plate 26.

In some embodiments, referring to FIG. 2, the apparatus base 27, the fuel conduit 24 and each fuel nozzle 25 may be configured together in an integral, monolithic body. Each fuel nozzle 25 and its respective splash plate 26 may also or alternatively be configured together in the monolithic body. In such embodiments, selecting the first acute angle 76 of FIG. 4 to be between sixty degrees and eighty degrees (e.g., approximately or exactly seventy degrees) and/or the second acute angle 80 to be between ten degrees and thirty degrees (e.g., approximately or exactly twenty degrees) may facilitate additive manufacturing of the turbine engine apparatus 20 as a monolithic body. The present disclosure, however, is not limited to such an exemplary construction. For example, in other embodiments, one or more or each of the apparatus components and/or portions thereof may be individually formed and subsequently connected (e.g., fastener and/or bonded) together.

Figure 12:
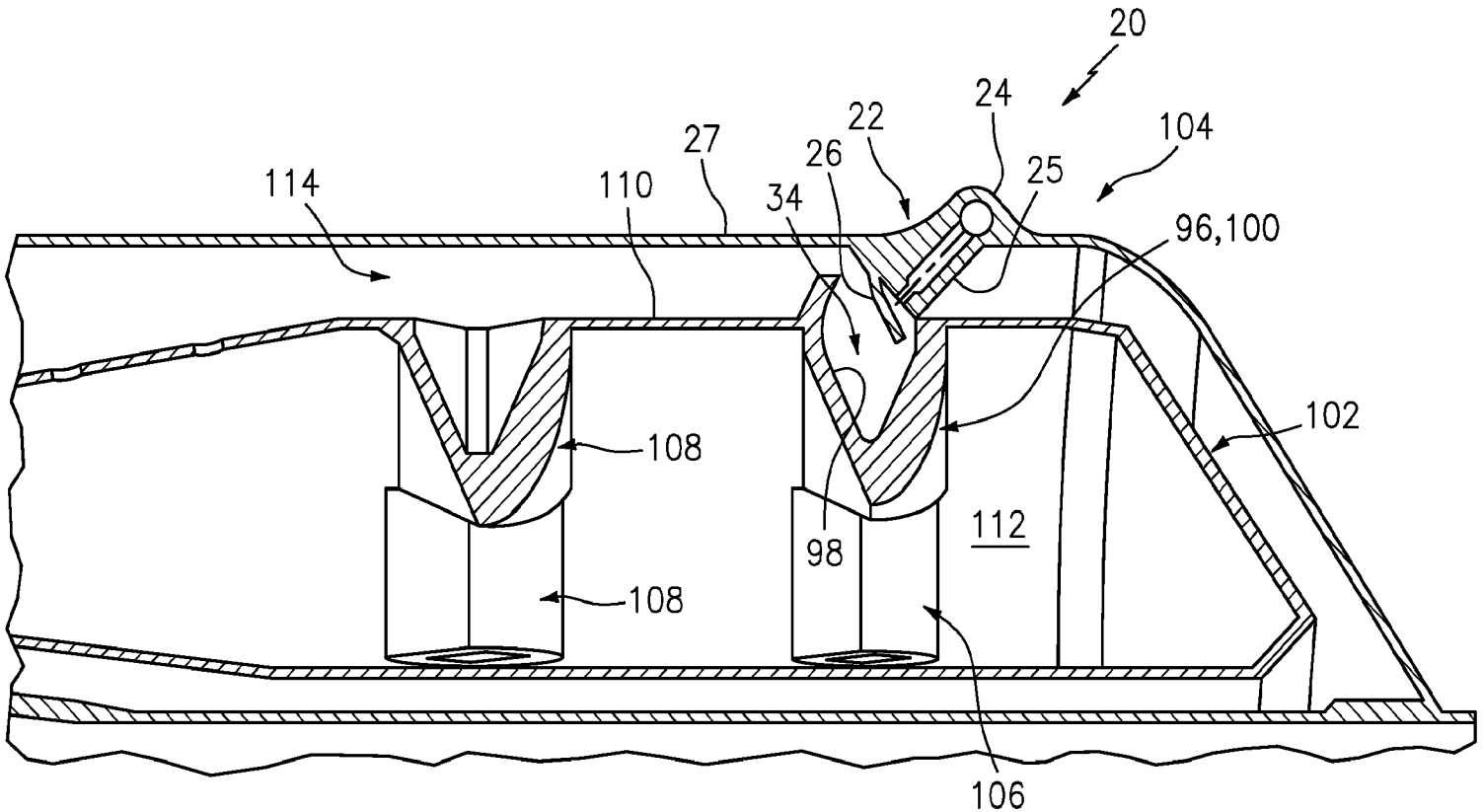
FIG. 12 is a perspective side sectional illustration of another portion of the combustor section.

In some embodiments, referring to FIGS. 11 and 12, the turbine engine apparatus 20 may also include one or more fuel vaporizers 96. Each fuel nozzle 25 is arranged with a respective one of the fuel vaporizers 96. More particularly, each fuel nozzle 25 projects into a respective one of the fuel vaporizers 96 and the associated splash plate 26 is arranged within a fluid passage (e.g., an air passage) of the respective fuel vaporizer 96. With such an arrangement, each splash plate 26 may direct a portion of the dispersed fuel to impinge against a surface 98 of the respective fuel vaporizer 96. The fuel vaporizer 96 may provide initial or further vaporization of the dispersed fuel. Each splash plate 26 may also direct another portion of the dispersed fuel to mix with the passing fluid (e.g., air) without impinging against the fuel vaporizer 96.

The ratio of an amount of the dispersed fuel which contacts the fuel vaporizer 96 versus an amount of the dispersed fuel which does not contact the fuel vaporizer 96 may be controlled by adjusting a value of the first acute angle 76 of FIGS. 4 and 6. For example, when the value of the first acute angle 76 is increased towards ninety degrees (e.g., see FIG. 4), more of the fuel dispersed by the splash plate 26 may penetrate further into the fluid flow and, thus, more of the dispersed fuel may contact the fuel vaporizer 96 (see FIG. 12). By contrast, when the value of the first acute angle 76 is decreased towards zero degrees (e.g., see FIG. 6), less of the fuel dispersed by the splash plate 26 may penetrate far into the fluid flow and, thus, less of the dispersed fuel may contact the fuel vaporizer 96 (see FIG. 12).

In the specific embodiment of FIGS. 11 and 12, each fuel vaporizer 96 is configured as a structure such as a flow tube 100 (e.g., a fluid tube, an air tube) for a combustor 102 in the combustor section 104. Note, the combustor 102 may also include at least one flow tube 106 in between, for example, each circumferentially neighboring set of the vaporizers 96 and/or one or more flow tubes 108 in another (e.g., forward/upstream) array. Each of the flow tubes 100, 106, 108 is connected to and projects out from a wall 110 of the combustor 102 and into a combustion chamber 112 at least partially defined by the combustor wall 110. The fluid passage 34 (e.g., air passage) of each flow tube 100 is configured to receive fluid and, more particularly, compressed air from a compressor section of the turbine engine (not visible in FIGS. 11 and 12) through another plenum 114. This compressed air is directed through the respective fluid passage 34 and into the combustion chamber 112. However, before reaching the combustion chamber 112, the air within the respective fluid passage 34 is mixed with fuel dispersed from a respective one of the splash plates 26 to provide a mixture of compressed air and atomized fuel. By dispersing the fuel within the flow tube 100, the fuel may be more likely to atomize within the respective fluid passage 34; e.g., upon dispersing into the airflow and/or upon impinging against the surface 98 (e.g., an inner side wall surface of the flow tube 100). By increasing atomization of the fuel, the fuel injector assembly 22 may reduce the likelihood of carbon buildup within the fluid passage 34 and/or within the combustion chamber 112.

In some embodiments, each fuel vaporizer 96/flow tube 100 is configured to direct an axial fluid flow therewith/therethrough. The term axial fluid flow may describe a straight or linear flow of fluid such as a non-swirled fluid flow; e.g., non-swirled air. For example, none of the fuel vaporizers 96/flow tubes 100 is configured with or otherwise receives its fluid (e.g., air) directly and/or indirectly from a swirler. Thus, the fluid flowing through each fuel vaporizer 96/flow tube 100 is non-swirled; e.g., the fluid primarily (or only) has axial velocity/momentum components with little or no tangential velocity/momentum components. Of course, the fluid flowing through each fuel vaporizer 96/flow tube 100 may include relatively low level flow disruptions, turbulence, vortices, etc. caused when, for example, the fluid turns from the plenum 114 into the fluid passage 34, etc.

Figure 13:
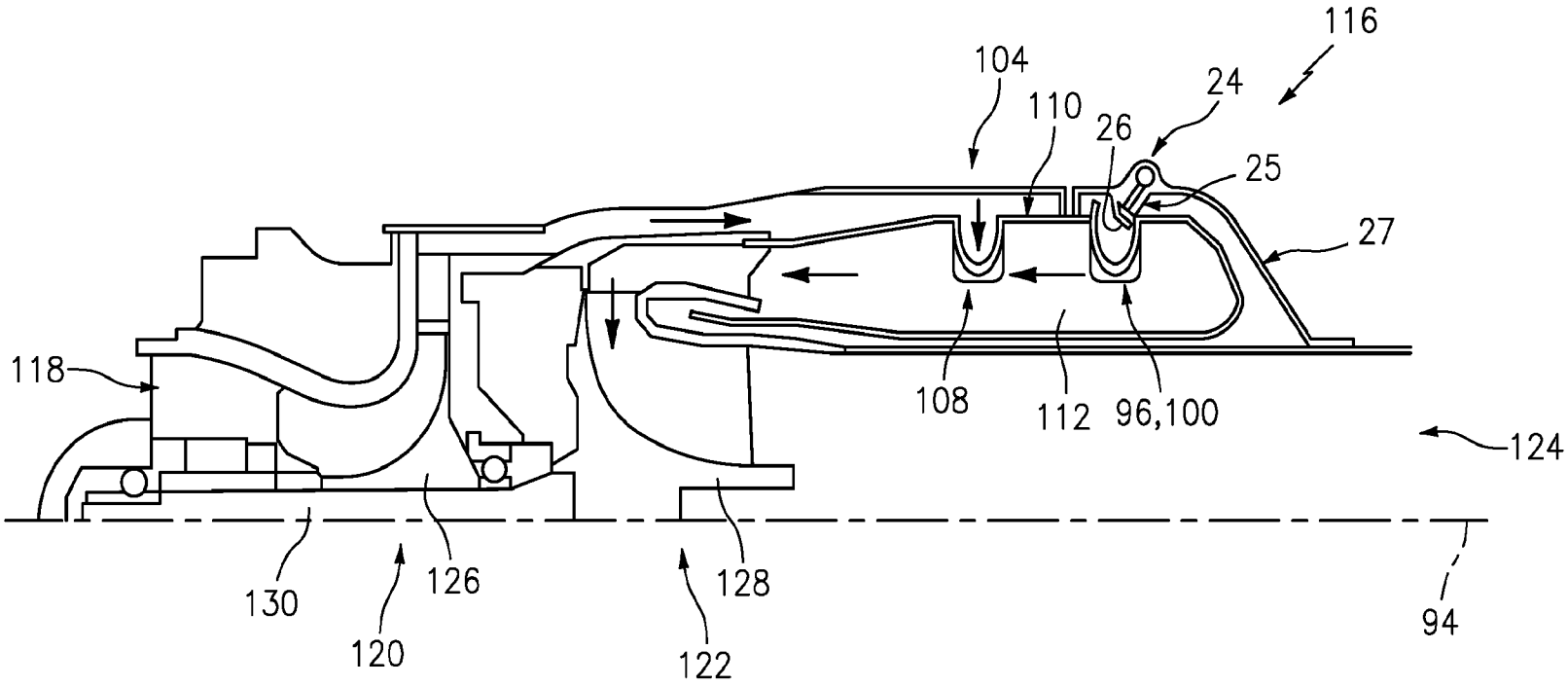
FIG. 13 is a schematic side illustration of a single spool, radial-flow turbojet turbine engine.

The turbine engine apparatus 20 of the present disclosure may be configured with various different types and configurations of turbine engines. FIG. 13 illustrates one such type and configuration of the turbine engine—a single spool, radial-flow turbojet turbine engine 116 configured for propelling an unmanned aerial vehicle (UAV), a drone, or any other manned or unmanned aircraft or self-propelled projectile. In the specific embodiment of FIG. 13, the turbine engine 116 includes an upstream inlet 118, a (e.g., radial) compressor section 120, the combustor section 104, a (e.g., radial) turbine section 122 and a downstream exhaust 124 fluidly coupled in series. A compressor rotor 126 in the compressor section 120 is coupled with a turbine rotor 128 in the turbine section 122 by a shaft 130, which rotates about the centerline/rotational axis 94 of the turbine engine 116.

The turbine engine apparatus 20 may be included in various turbine engines other than the one described above. The turbine engine apparatus 20, for example, may be included in a geared turbine engine where a gear train connects one or more shafts to one or more rotors in a fan section, a compressor section and/or any other engine section. Alternatively, the turbine engine apparatus 20 may be included in a turbine engine configured without a gear train. The turbine engine apparatus 20 may be included in a geared or non-geared turbine engine configured with a single spool (e.g., see FIG. 13), with two spools, or with more than two spools. The turbine engine may be configured as a turbofan engine, a turbojet engine, a propfan engine, a pusher fan engine or any other type of turbine engine. The present disclosure therefore is not limited to any particular types or configurations of turbine engines. The present disclosure is also not limited to a propulsion system application. For example, the gas turbine engine may alternatively be configured as an auxiliary power unit (APU) or an industrial gas turbine engine.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An apparatus for a turbine engine, comprising:

a fuel vaporizer comprising a vaporizer centerline and a fluid passage extending along the vaporizer centerline through the fuel vaporizer; and a monolithic body including a splash plate, a support member and a fuel nozzle, the splash plate including a splash plate surface, the support member connecting and extending between the splash plate and the fuel nozzle, the fuel nozzle including a nozzle orifice, the fuel nozzle configured to direct fuel out of the nozzle orifice to impinge against the splash plate surface, the splash plate surface angularly offset from the vaporizer centerline and configured to direct at least some of the fuel against the fuel vaporizer, the fuel nozzle projecting into a flow passage, the support member is upstream of the nozzle orifice relative to a fluid flow within the flow passage, and a width of the splash plate surface greater than a width of the nozzle orifice.

2. The apparatus of claim 1, wherein the fuel nozzle is configured to direct the fuel out of the nozzle orifice as a fuel jet; and the splash plate is configured to redirect the fuel jet into a radiant pattern of fuel.

3. The apparatus of claim 1, wherein the splash plate is spaced from and overlaps the nozzle orifice.

4. The apparatus of claim 1, wherein the splash plate surface comprises a planar splash plate surface.

5. The apparatus of claim 1, wherein the fuel nozzle is configured to direct the fuel out of the nozzle orifice along a trajectory to impinge against the splash plate surface; and the splash plate surface is angularly offset from the trajectory by an acute angle.

6. The apparatus of claim 5, wherein the acute angle is between sixty degrees and eighty degrees.

7. The apparatus of claim 5, wherein the acute angle is between thirty-five degrees and fifty-five degrees.

8. The apparatus of claim 1, further comprising a second support member connecting and extending between the splash plate and the fuel nozzle.

9. The apparatus of claim 1, wherein the fuel nozzle includes a nozzle tube that has and extends along a longitudinal centerline; and the nozzle orifice is coaxial with the longitudinal centerline.

10. The apparatus of claim 1, wherein the monolithic body further includes a turbine engine case; and the fuel nozzle projects out from the turbine engine case towards the fuel vaporizer.

* * * * *